US005503359A

United States Patent [19]

Patterson

[11] Patent Number: 5,503,359

[45] Date of Patent: Apr. 2, 1996

[54] MOUNTING BOX FOR CEILING FANS

[76] Inventor: Richard M. Patterson, P.O. Box 567, Hendersonville, N.C. 28793

[21] Appl. No.: 255,169

[22] Filed: Jun. 7, 1994

[51] Int. Cl.[6] ..... A47H 1/10

[52] U.S. Cl. ..... 248/317; 248/342; 248/906; 220/3.2

[58] Field of Search ..... 248/317, 906, 248/300, 343, 342; 220/3.2, 3.3, 3.8, 3.9

[56] References Cited

U.S. PATENT DOCUMENTS

| | | | |
|---|---|---|---|
| 2,374,622 | 4/1945 | Rugg | 174/58 |
| 2,429,443 | 10/1947 | Yeschick | 248/27 |
| 2,898,075 | 8/1959 | McGinty | 248/343 |
| 3,440,331 | 4/1969 | Cohen | 248/343 |
| 4,391,428 | 6/1983 | Grimes | 248/546 |
| 4,513,994 | 4/1985 | Dover et al. | 248/544 |
| 4,682,452 | 7/1987 | Propp et al. | 52/118 |
| 4,684,092 | 8/1987 | Reiker | 248/200.1 |
| 4,770,311 | 9/1988 | Wang | 220/3.3 |
| 4,788,383 | 11/1988 | Caison | 174/54 |
| 4,880,128 | 11/1989 | Jorgensen | 220/3.9 |
| 4,892,211 | 1/1990 | Jorgensen | 220/3.2 |
| 4,919,292 | 4/1990 | Hsu | 220/3.2 |
| 5,024,412 | 6/1991 | Hung et al. | 248/343 |
| 5,143,339 | 9/1992 | Ashcraft et al. | 248/343 |
| 5,234,119 | 8/1993 | Jorgensen et al. | 272/3.9 |
| 5,272,279 | 12/1993 | Filshie | 174/50 |

*Primary Examiner*—Leslie A. Braun
*Assistant Examiner*—Anita M. King
*Attorney, Agent, or Firm*—W. Thad Adams, III

[57] ABSTRACT

A box assembly device for mounting ceiling fans in cathedral or other ceilings with exposed rafters. The device consists of a formed or molded box, intended to mount between exposed rafters or joists, with mounting facilities for an electrical ceiling fan. The device has provisions for the electrical wiring to be mounted above the device, in the accepted manner, with the fan being located below the decorative box. In addition to decoration, the box serves the purpose of providing a convenient and quick mounting platform.

3 Claims, 3 Drawing Sheets

MOUNTING BOX FOR CEILING FANS

TECHNICAL FIELD AND BACKGROUND OF THE INVENTION

The present invention relates to means for mounting electrical ceiling fans in rooms with cathedral-style ceilings. These ceilings typically have exposed rafters or joists. Ceiling fans are mounted to wooden support members installed between two adjacent rafters. Accepted practice for mounting ceiling fans in cathedral ceilings is for the contractor to mount the ceiling fan to a support consisting of 2×4 studs, which can be unsightly. Another option is for the finish carpenter to measure, cut and build a wooden frame between the rafters or exposed joists. This is a relatively expensive process, and, unless the carpenter is skilled, produces an unattractive mounting. At best, the results are unpredictable.

There are various inventions which are supports or frames for mounting ceiling fans in ordinary covered ceilings, but at the present time, the inventor is unaware of any pre-manufactured mounting device. U.S. Pat. No. 4,892,211, Jorgenson, describes a means for mounting ceiling fans in horizontal ceilings, but does not include a decorative mounting box, and is not applicable to cathedral-style ceilings. The Jorgenson device is intended to replace the electrical service box common in the art. U.S. Pat. No. 5,024,412, Hung et al., discloses another means for mounting ceiling fans between ceiling joists, but does not include means for concealing unsightly wires or mounting devices in an exposed mounting position. The device is intended to be located behind a decorative ceiling surface. U.S. Pat. No. 4,391,428, Grimes, is similarly a support system located behind a decorative ceiling surface, as is U.S. Pat. No. 4,513,994, Dover et al. The present invention is intended to be visible from the living area of the room in which the fan is mounted, and does not provide support for the electrical service box, which avoids conflict with existing building code requirements for electrical service.

SUMMARY OF THE INVENTION

I have developed and invented a new and improved means of mounting ceiling fans in rooms with cathedral-style ceilings. The invention consists of a mounting box, shaped and sized to receive the base of an electrical ceiling fan and to allow quick and simple mounting between common sizes and spacings of ceiling joists. The invention has no electrical connections or fittings and does not support the weight of the fan. The invention can be painted or finished to match the interior of the room in which it is mounted.

DETAILED DESCRIPTION OF THE INVENTION

Figure 1:
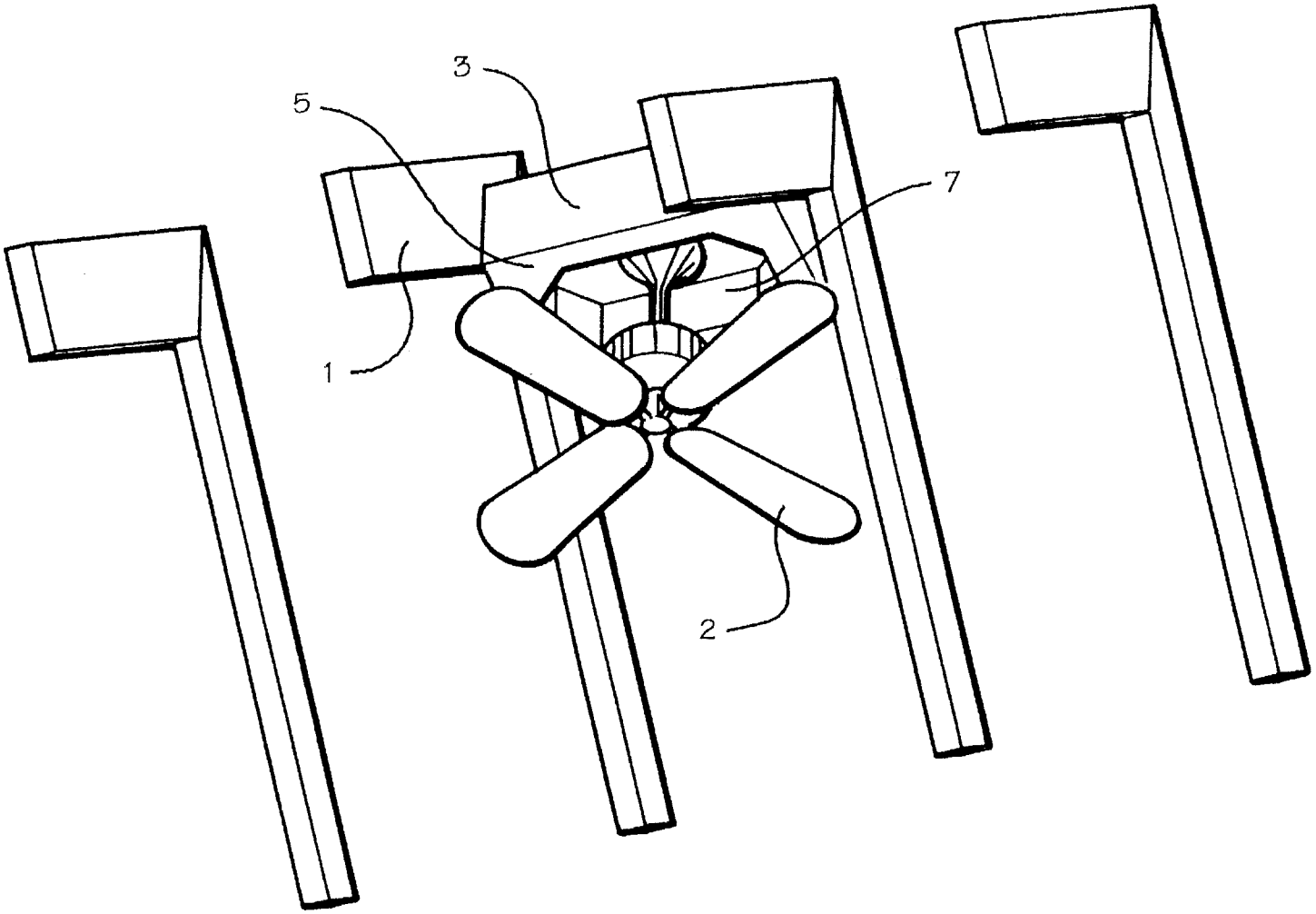
FIG. 1 is a pictorial representation of a preferred embodiment of the invention in perspective view showing the mounting box with fan mounted and attached to a ceiling.

Many variations and modifications of the embodiments of the invention will be apparent to those skilled in the art without departing from the scope of the invention, which is defined in the claims appended hereto. Referring now to the figures, FIG. 1 shows a perspective view of the invention with a typical electrical ceiling fan mounted as it would appear in a room with a cathedral type ceiling. The device is attached to two adjacent ceiling rafters 1 and electrical service is provided in the manner common in the art. The device is mounted through its opposed parallel outer walls 3, which are dimensioned so as to fit between rafters spaced according to common practice in the building arts. For example, ceiling rafters are usually spaced either 24 inches or 16 inches on center, so the exterior dimensions of the device will be 22 inches long by 14 inches wide. A common electrical ceiling fan 2 is mounted into the recessed portion of the device, which allows for greater clearance from the floor to the lower portion of the fan 2.

Figure 2:
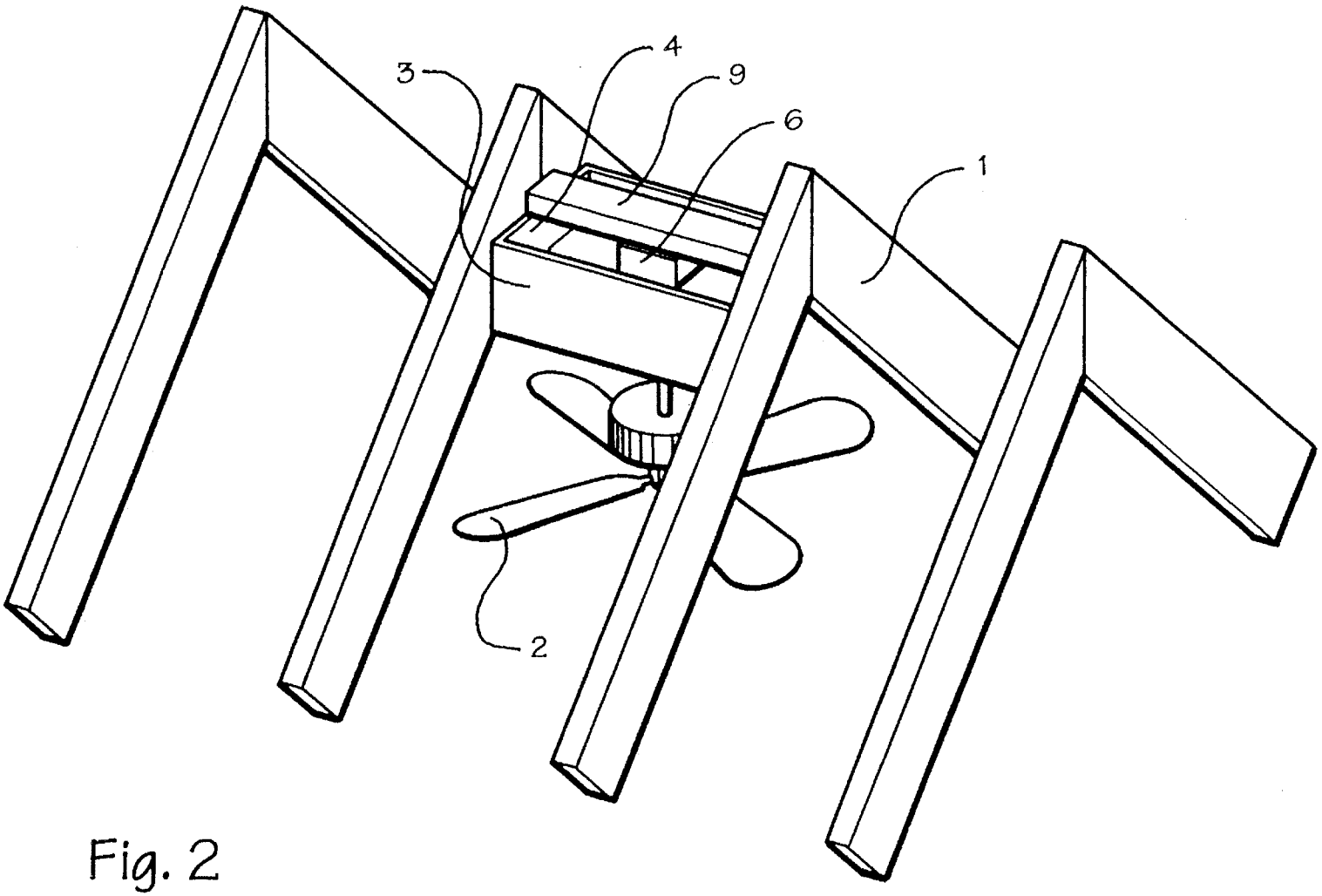
FIG. 2 is a pictorial representation of a preferred embodiment of the invention in perspective view, showing the mounting box with fan mounted and attached to a ceiling from above.

FIG. 2 shows a perspective view of the device from above a typical ceiling installation, with the device mounted between two ceiling rafters 1 by two parallel outer walls 3. Above the device is a support 9 common in the art, typically constructed of two 2×4 studs mounted between adjacent ceiling rafters, as here 1, with an electrical supply box 6 common in the art to provide support and connections for the required electrical wiring.

Figure 3:
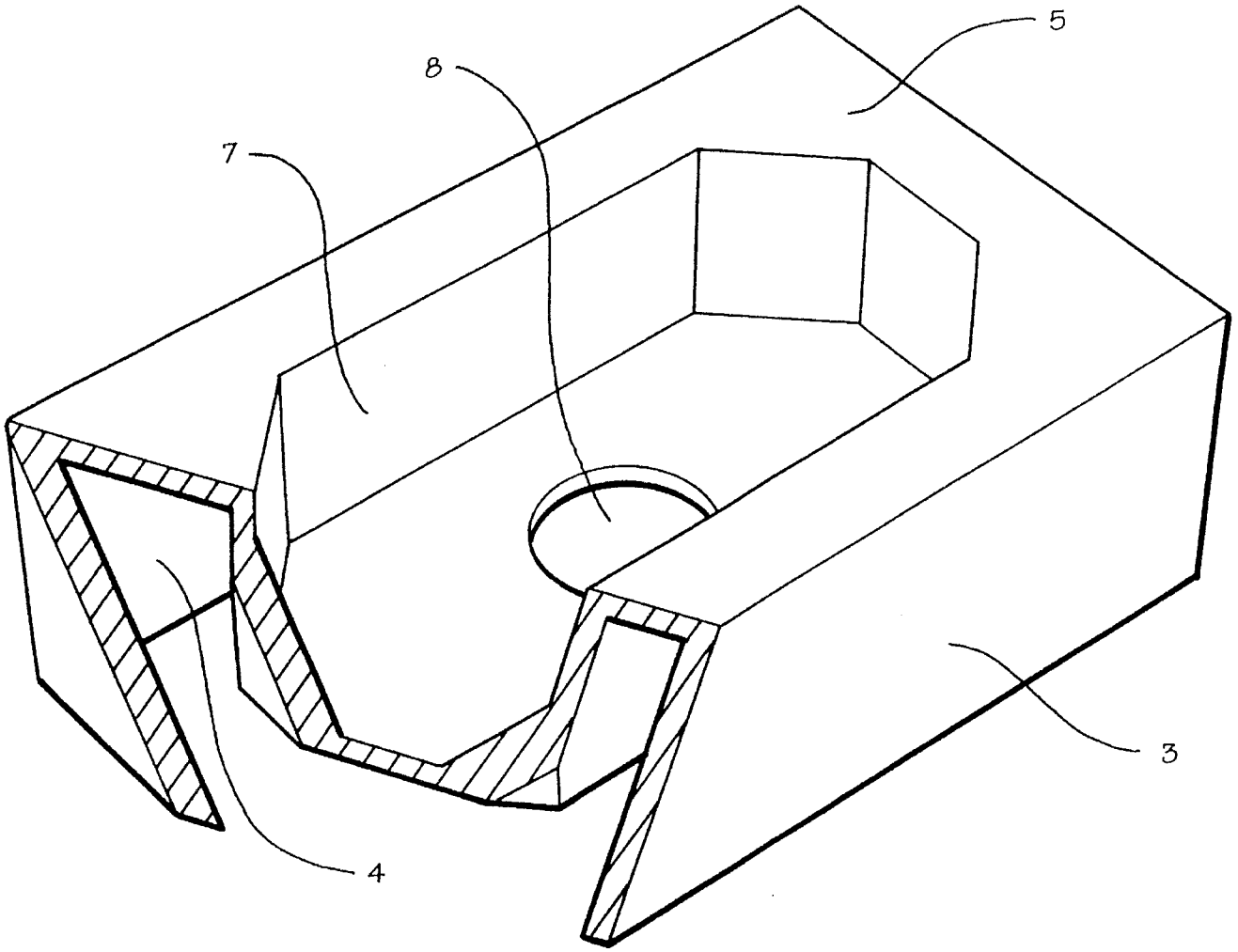
FIG. 3 is an elevation view drawing of the invention, partly cut away.

FIG. 3 is an elevation view of the mounting box device, showing the outer walls 3 of the box, the inner wall 4, the exposed surface 5 which faces the living area of the room in which the device is mounted, the electrical service opening 8 through which the base of the ceiling fan 2 is mounted to the electrical service box 6 mounted to the support 9, and the receptacle walls 7 which form the interior receptacle for receiving the base of the ceiling fan.

The embodiments described above are merely descriptive of its principles and are not to limit the scope of the invention set out in the following claims.

I claim:

1. In combination with an electric fixture mounted to a cross-support interposed between adjacent exposed beams of a cathedral ceiling, an electric service box accommodating electric wiring connected to the fixture, and a box assembly located between the adjacent exposed beams and below the cross-support for shielding the cross-support and electric service box from the view of an upwardly-looking viewer, said box assembly comprising:

(a) a first pair of outer side walls shaped to fit between the adjacent exposed beams of the cathedral ceiling, and disposed generally perpendicular to the adjacent exposed beams;

(b) a second pair of outer side walls attached to the first pair of outer side walls, and disposed generally parallel to the adjacent exposed beams of the cathedral ceiling;

(c) a bottom wall attached to a lower edge of the first and second pairs of outer side walls, and defining an exposed viewing surface adapted to be seen by the upwardly-looking viewer;

(d) a plurality of receptacle side walls extending upwardly from the bottom wall, and defining a recessed receptacle therein receiving a mounting end of the fixture; and (e) a top receptacle wall attached to the receptacle side walls and forming an inner recess floor, said inner recess floor defining an electrical service opening therein allowing passage of electric wires from the mounting end of the fixture to the electric service box, whereby said electric fixture is supported solely by said electric service box.

2. A combination according to claim 1, wherein the box assembly is constructed of a rigid, molded polymer material.

3. A combination according to claim 1, wherein the first pair of outer side walls are 22 inches in length, and the second pair of outer side walls are 14 inches in length.

* * * * *